US005080452A

United States Patent [19]

Tuckman

[11] Patent Number: 5,080,452

[45] Date of Patent: Jan. 14, 1992

[54] INTEGRAL STORAGE RECEPTACLE FOR PERSONAL COMPUTER

[76] Inventor: Tab R. Tuckman, 17 Wheeler Rd., Kendall Park, N.J. 08824

[21] Appl. No.: 487,427

[22] Filed: Mar. 1, 1990

[51] Int. Cl.[5] ..... A47B 63/00; B65D 85/57

[52] U.S. Cl. ..... 312/242; 206/214; 312/7.2; 312/348.3; 361/331; 364/708

[58] Field of Search ..... 206/214, 320; 312/7.2, 312/204, 242, 293, 348, 348.3; 364/708, 709.1; 361/331

[56] References Cited

U.S. PATENT DOCUMENTS

| | | | |
|---|---|---|---|
| 3,703,326 | 11/1972 | Riviers | 312/348.3 |
| 4,076,350 | 2/1978 | Crist | 312/242 |
| 4,245,872 | 1/1981 | Kakigi | 312/242 |
| 4,313,584 | 2/1982 | Fukunaga | 312/242 X |
| 4,481,617 | 11/1984 | Mabry . | |
| 4,595,246 | 6/1986 | Bross | 312/348.3 |
| 4,688,131 | 8/1987 | Noda et al. . | |
| 4,712,843 | 12/1987 | Castelli et al. | 312/242 |
| 4,736,332 | 4/1988 | Crease | 364/708 |
| 4,894,792 | 1/1990 | Mitchell et al. | 364/708 |

*Primary Examiner*—Bryon P. Gehman
*Attorney, Agent, or Firm*—Watov & Kipnes

[57] ABSTRACT

A box-shaped receptacle including a front opening is mounted through the front panel of a personal computer, in an unused floppy disk area of the latter, for storing items such as pencils, paper clips, erasers, floppy disks, and so forth. The interior of the receptacle may be compartmentalized to facilitate the storage of different sized items.

15 Claims, 4 Drawing Sheets

INTEGRAL STORAGE RECEPTACLE FOR PERSONAL COMPUTER

FIELD OF THE INVENTION

The field of the present invention relates generally to personal computers, and more particularly to storage compartments associated with enclosures or housings for personal computers or computer work stations.

BACKGROUND OF THE INVENTION

Since the introduction of the personal computer and computer work stations to the marketplace, a variety of various accessories for facilitating the use of such computers have been developed. For example, many different types of desk, cabinets, and other separate accessories have been developed for providing ergonometric separate accessories for facilitating the use of such computers.

Many personal computers, and smart computer work stations, are provided with a plurality of floppy-disk slot spaces accessible at the front panel of the computer housing. In many applications, one or more of the available floppy-disk slots remain unused, and are covered by a blank coverplate of metal or plastic, for example. When a user desires to install an additional floppy-disk drive, the coverplate is removed and the floppy-disk drive mechanism is installed in the space provided behind the coverplate.

In using a computer, it is often necessary to keep close at hand writing instruments, such as pens, pencils, erasers, and so forth. Also, it is often necessary to interchange a number of different floppy disk for preparing different documents, or otherwise operate in the computer to perform various tasks. To neatly store the floppy disks, writing implements, and so forth, it is necessary to have either various storage containers adjacent to the computer, or to utilize drawers and cabinets associated with the computer workbench. Otherwise, these various items would be strewn about the work surface of the computer work station, making for an inefficient work environment. The present inventor discovered that the unused floppy disk slots in a typical personal computer or smart work station can be included as part of a small accessory storage system for enhancing the use of such computers and work stations.

SUMMARY OF THE INVENTION

With the problems of the prior art in mind, one object of the present invention is to provide a small accessory storage system for writing implements, erasers, paper clips, extra floppy disks, and so forth, as an integral part of a housing or enclosure for a personal computer or work station.

Another object of the invention is to provide a small item storage system for installation in the unused floppy disk slots of a personal computer or smart work station.

Yet another object of the invention is to provide a small item storage system that is readily accommodated in the unused floppy disk slot of a personal computer, and includes readily changeable storage configurations.

With these and other objects in mind, one embodiment of the invention includes a drawer-like storage compartment or receptacle including means for permitting the receptacle to be securely mounted in the unused floppy-disk slot of a personal computer or work station. The front of the receptacle is open, providing a box-like configuration, in which various items may be stored immediately above the keyboard of a personal computer, for example. Another embodiment of the invention includes inserts selectively installable in the receptacle for compartmentalizing the interior space thereof. The inserts permit items such as paper clips, erasers, and so forth to be placed within a forwardmost compartment or compartments, for permitting easy access thereto. Other compartments permit ready storage of pencils, pens, extra floppy disks, and so forth.

BRIEF DESCRIPTION OF THE DRAWINGS

Various illustrative embodiments of the invention are described below in detail, with reference to the following drawings, in which like items are identified by the same reference designation, wherein.

DETAILED DESCRIPTION OF THE INVENTION

Figure 1:
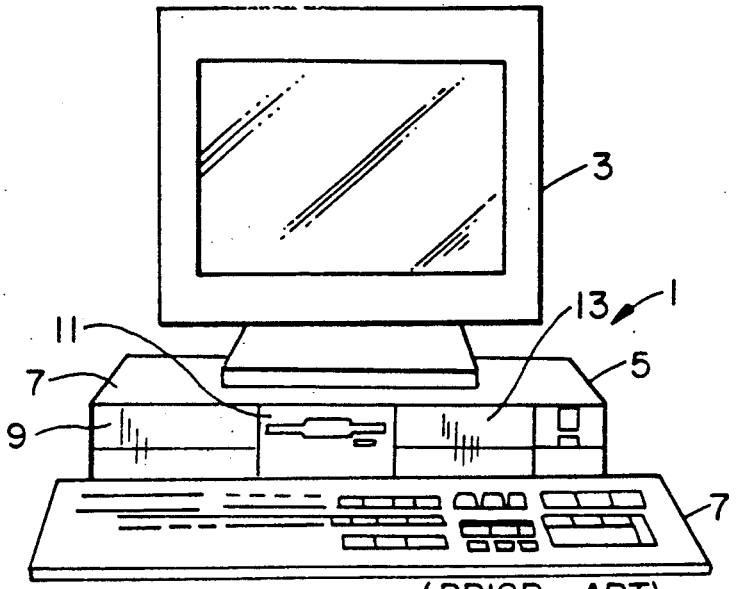
FIG. 1 (PRIOR ART)
FIG. 1 is a front perspective view of an "IBM PS/2" personal computer (IBM PS/2 is a trademark of the International Business Machines Corp.).

In FIG. 1, a typical configuration 1 for an IBM PS/2 (trademark of International Business Machines Corp.) personal computer is shown. The configuration 1 includes a monitor 3, computer 5, and a keyboard 7. The computer 5 is housed in an enclosure 7 that includes a front panel 9. In this illustration, the front panel 9 also includes a floppy-disk drive 11, and a coverplate 13, for covering an unused floppy-disk slot or area.

Figure 2:
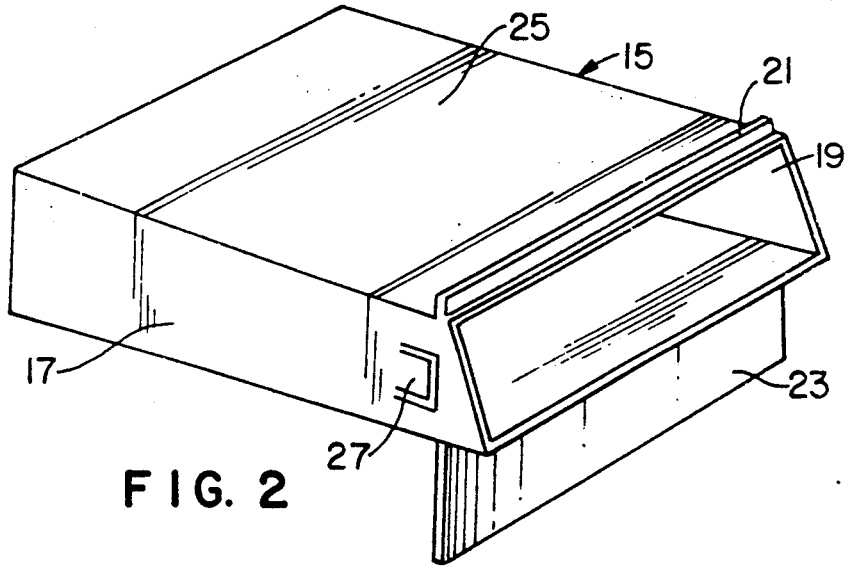
FIG. 2 shows a perspective view looking towards the left front and side of a box-like drawer configuration of one embodiment of the invention, particularly adapted for the "IBM PS/2" computer.
Figure 3:
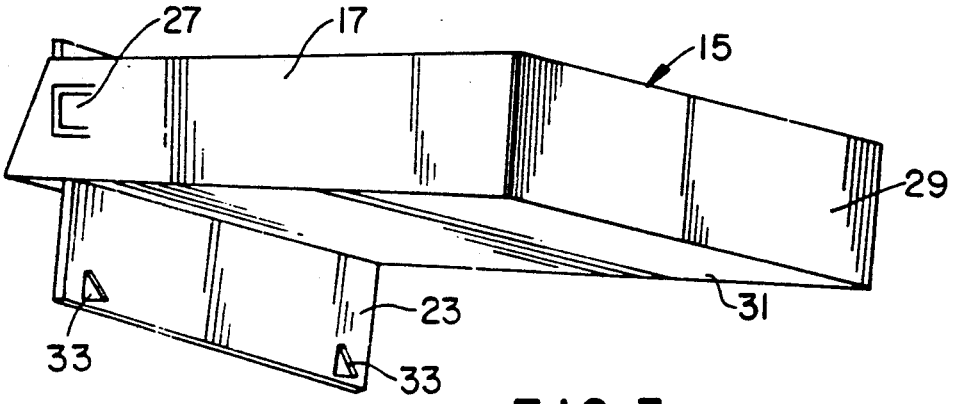
FIG. 3 is a perspective view looking towards the left side and back of the embodiment of the invention of FIG. 2.

In one embodiment of the invention, as shown in FIG. 2, a box-like storage compartment or drawer 15 includes, in this example, wedge shaped sides 17 that diverge toward a slanted open front portion 19 having an upper retaining rib or flange-like panel 21 slightly rearward from the top edge of the opening 19. A bottom panel 23, slightly rearward of the bottom edge of the opening 19 is substantially perpendicular to the bottom of the compartment 15, and lies in the same vertical plane as the upper rib or stub-like panel 21. The compartment 15 also includes a top surface 25, and locking tabs 27 on each side 17. The front edge of the locking tabs 27 lie proximate and very slightly rearward of the common vertical plane of panels 21 and 23. As shown in FIG. 3, the compartment, receptacle, or drawer 15 also includes a closed back 29 and bottom 31, in this example. A pair of index or triangularly shaped index or guide tabs 33, are shown for indexing or mating with slots 35 located on the front panel 9 behind coverplate 13, as shown in FIG. 4.

Figure 4:
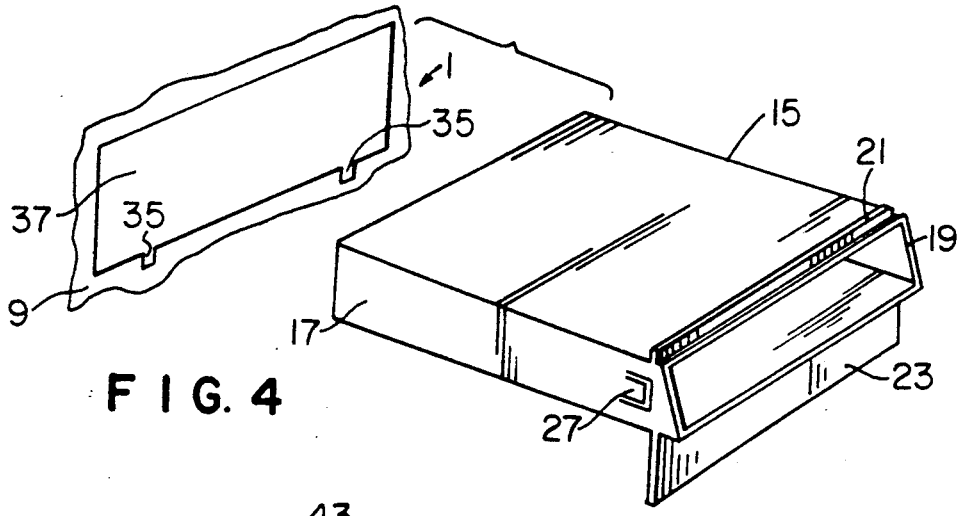
FIG. 4 is a pictorial exploded assembly diagram for the embodiment of the invention of FIGS. 2 and 3.

With further reference to FIG. 4, the storage receptacle 15 is inserted into an opening 37 of computer 1 exposed by removing coverplate 13. One receptacle 15 is slid into the opening 37 with the upper flange 21 substantially touching the upper portion of panel 9 just above the opening 37, along with the index tabs 33 entering into the slots 35 in the lower portion of panel 9 below the opening 37. The locking tabs 27 will snap into place on the back of the panel 9 just behind and to the right and left sides of opening 37. Note that the locking tabs 27 are formed by a U-shaped slot-like cutout portion in each side of the receptacle 15. The tabs 27 so formed are bent slightly away from their associated sides 17 in a manner making them protrude to the outside of their associated side 17. Since the tabs 27 are fabricated from a material having elastic memory, such as a plastic material forming the receptacle 15, for example, when the latter is pushed far enough into the opening 37, the tabs 27 will first be pushed inward by the side portions of opening 37, and then snap back out behind panel 9 when receptacle 15 is pushed slightly further into opening 37, thereby locking receptacle 15 into the opening 37. Items such as pencils, pens, extra floppy disks, and so forth can now be stored in receptacle 15 for immediate and easy access by a user of the computer 1. As will be shown below, this embodiment of the invention can be modified to provide a similar receptacle for use in substantially any personal computer having an unused floppy disk slot.

Figure 5:
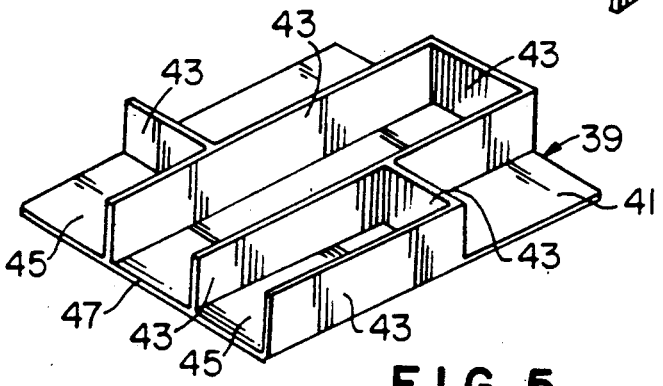
FIG. 5 is a pictorial view of another embodiment of the invention showing an insert for selectively compartmentalizing storage drawers or compartments of various embodiments of the invention.

In another embodiment of the invention, as shown in FIG. 5, an insert 39 includes a base 41 upon which are formed a plurality of wall-like partitions 43 for dividing the top of the base 41 into a plurality of different size compartments 45, in a selective and predetermined manner. The insert 39 is slid into the opening 19 of receptacle 15 so that the front portion 47 of insert 39 is proximate the opening 19. In this manner, by providing different size compartments 45, on the base 41, items such as paper clips, and erasers, can be kept within easy reach in receptacle 15 by using the shallow ones of the compartments 45, whereas the longer ones of the compartments 45 serve to hold such items as pencils and pens, for example.

Figure 6:
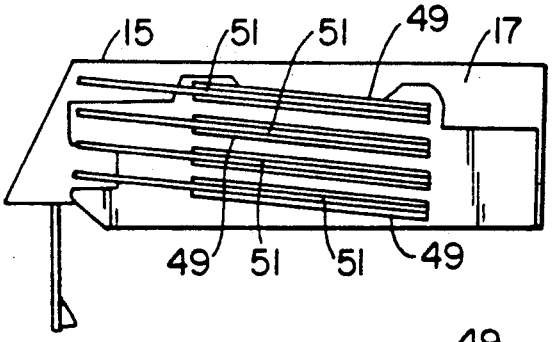
FIG. 6 is a partial cutaway view of another embodiment of the invention for storing floppy disks.
Figure 7:
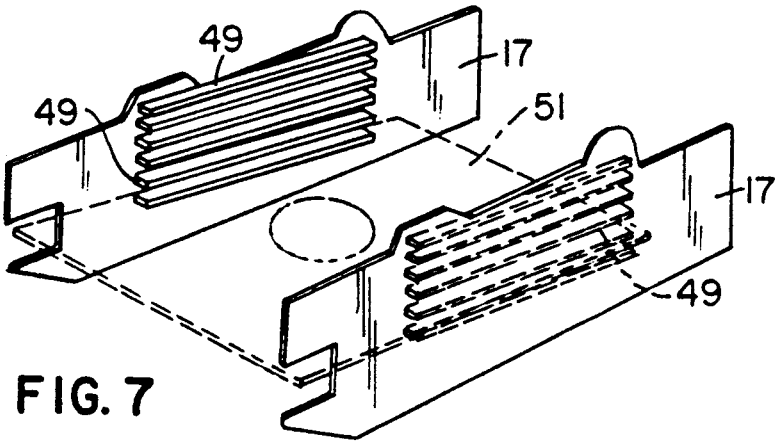
FIG. 7 is a partial pictorial view of the embodiment of the invention of FIG. 6.

Another embodiment of the invention as shown in FIGS. 6 and 7 can either be incorporated on an insert 39, or can be made part of the receptacle 15 itself. In this example, assume that the embodiment shown in FIGS. 6 and 7 is formed integrally with the side walls 17 of receptacle 15. As shown, two opposing and spaced apart columns of pairs of spaced apart tabs or studs 49 are located on the inside face of each side 17, as shown. In the preferred embodiment, as shown in FIG. 6, the two columns of spaced apart pairs of tabs 49 are arranged so that the frontmost column of tabs 49 are slightly higher then associated ones of the pairs of tabs 49 forming a column in a rearward portion of an associated side 17. Similarly located opposing pairs of the tabs 49 in each column of an associated side 17 provide guide ways for permitting items such as floppy disks 51 to be stored in the receptacle 15, as shown. As shown in FIG. 6, the floppy disks are in a preferred embodiment held at an angle by the pairs of opposing associated tabs 49 being located in respective columns that are skewed from one another, as previously mentioned.

Figure 8:
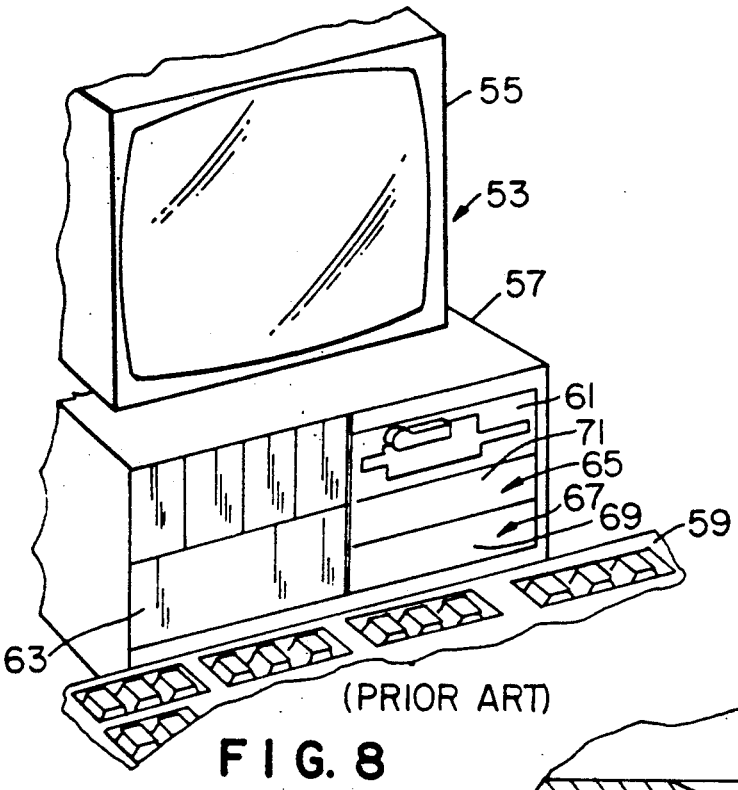
FIG. 8 is a partial perspective view looking from the left of a typical personal computer in which various embodiments of the invention may be used.

In FIG. 8, a front pictorial view looking slightly from the left is shown of a typical personal computer configuration 53. The computer 53 includes a monitor 55, the computer itself 57, a keyboard 59, a floppy disk drive 61 located on a front panel 63, and two unused floppy disk spaces 65 and 67, typically covered by blank coverplates 69 and 71, as shown. In another embodiment of the invention, a receptacle 73 formed in a box-like configuration similar to that of receptacle 15, includes a front opening 75 for providing access to the interior of the receptacle 73, a topmost stub-like flange 77 slightly rearward of the front lip of the opening 75, and a bottom flange portion 79 located in the same vertical plane as flange 77, as shown. In this example, the bottom edge of the opening 75 is forward protruding relative to the top edge of the opening 75, thereby providing a slanted opening for facilitating the qrasping of items retained in receptacle 73. A locking tab 81, similar to locking tab 27 of receptacle 15, is included on each side 83 of receptacle 73. The locking tabs 81 serve the same function as the locking tabs 27 of receptacle 15. Also, an additional locking or retaining mechanism 85 is included at the bottom portion of receptacle 73, slightly rearward of the vertical plane formed by flanges 77 and 79, as shown.

Figure 10:
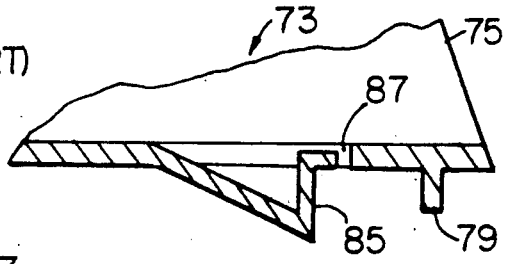
FIG. 10 is a partial cross sectional view of a locking hinge or tab associated with the embodiment of the invention of FIG. 9.
Figure 9:
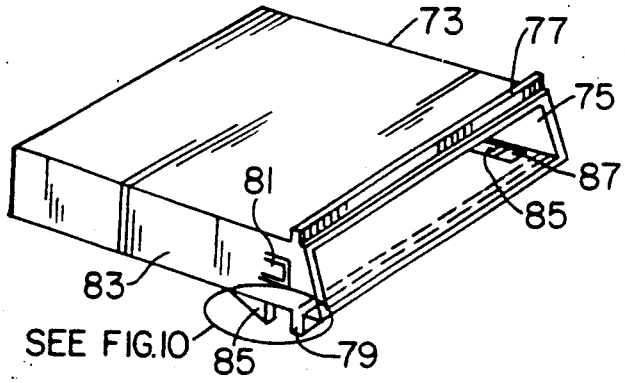
FIG. 9 shows another embodiment of the invention in a front perspective view looking from the left.

With further reference to FIG. 9, and also with reference to FIG. 10, each of two locking tabs or fingers 85 are relatively narrow, and located with a top portion in a slot-like opening 87 through the bottom of the receptacle 73 near opening 75, and adjacent each side 83, as shown. A locking tab 85 is in this example formed from a finger-like or triangularly shaped portion 85 of the receptacle 73, which is typically fabricated from a plastic material having plastic memory. Accordingly, in this example, the receptacle 73 is slid into a spare floppy-disk space of computer 57 to the point where the locking tabs 81 and 85 snap into place behind the front panel 63 of computer 53, for securing receptacle 73 between the locking tabs 85 and 81, on the inside face of panel 63, and the flanges 77 and 79 on the outside face of panel 63. Inserts 39, as previously described with reference to FIG. 5, can be slid into the receptacle 73, for compartmentalizing the same. Regardless, in this embodiment of the invention, the receptacle 73 provides storage for various items associated with using the computer 53, as previously described relative to receptacle 15.

Figure 12:
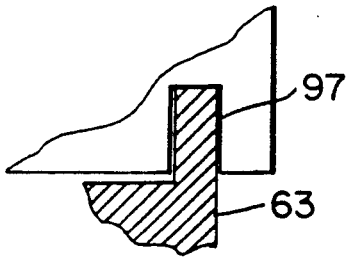
FIG. 12 is a partial cross sectional enlarged view of a retaining slot associated with the embodiment of the invention of FIG. 11.
Figure 11:
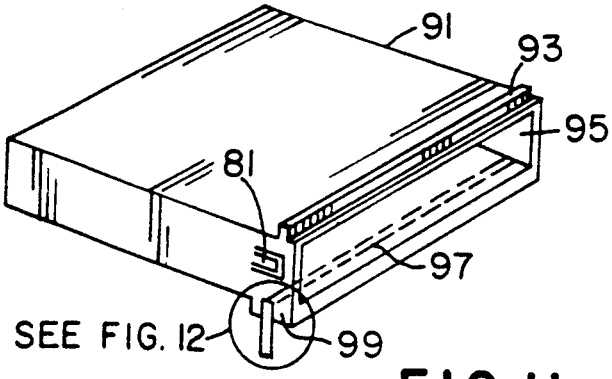
FIG. 11 is a front perspective view looking from the left of yet another embodiment of the invention.

In yet another embodiment of the invention, as shown in FIG. 11, a storage receptacle 91 includes a top flange slightly rearward of the front opening 95 of receptacle 91, as shown. With further reference to FIG. 11, and also with reference to FIG. 12, the receptacle 91 further includes an elongated slot 97, through the bottom width of the receptacle 91 juxtaposed to the vertical plane including flange 93. In this example, the slot 97 is included in a stub-like boss 99 protruding from the bottom of the receptacle 91 at the frontmost portion thereof, as shown. In an alternative embodiment, instead of having the narrow elongated boss 99 across the entire bottom width of the receptacle 91, for including the slotway 97, two narrow bosses could be located at either end of the frontmost portion of the bottom of the receptacle 91, with each such short boss including a slot 97. Regardless, the receptacle 91 is mounted within a spare floppy disk space 71 by sliding it into the space 71 until the back of the boss 99 or bosses 99 touch a front portion of the panel 63, at which point the receptacle 91, is lifted slightly up from its front opening 95 to permit the boss 99 to slide over the lower lip of the front panel 63 about the access hole for the spare floppy disk, and the receptacle 91 is then lowered onto the bottom lip for placing the latter into the slotway 97, thereby securing the receptacle 91 into the spare floppy disk space.

Figure 13:
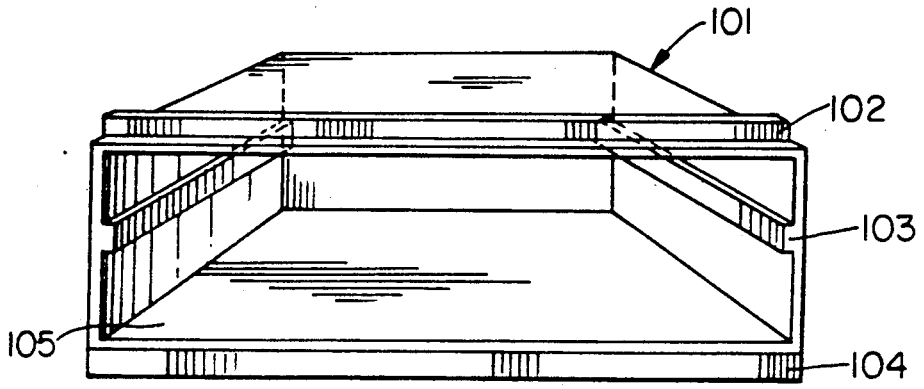
FIG. 13 is a front perspective view of a holder for a drawer, of another embodiment of the invention.
Figure 14:
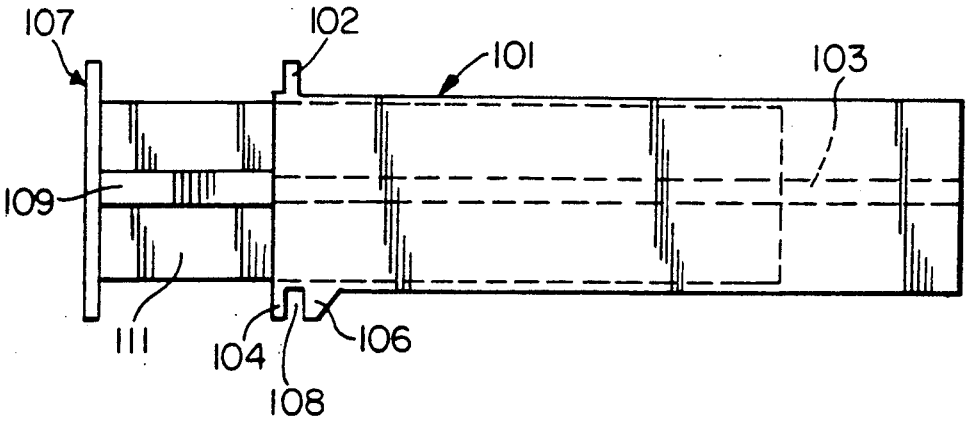
FIG. 14 is a side view of the embodiment of the invention of FIG. 13 showing the partial installation of a slidably removable drawer into the holder or receptacle.

In another alternative embodiment of the invention, as shown in FIGS. 13 and 14, a receptacle 101 is included in the form of an enclosure for a drawer 111 having rails 103, for permitting a drawer 105 to be slid into a spare floppy disk space via standard rails 105 mounted on either side of the space in the computer 57 for the spare floppy disk (see FIG. 14).

The various embodiments of the invention illustrated and described above are not meant to be limiting. Those of ordinary skill in the art may recognize certain modifications for these embodiments, without departing from the spirit and scope of the invention and the appended claims. The appended claims are meant to cover such modifications.

In another alternative embodiment of the invention, as shown in FIGS. 13 and 14, a drawer holder or receptacle 101 includes an open front 105, interior side rails 103, a top front lip or stop member 102, and a bottom front lip or stop member 104. The drawer receptacle 101 is mounted into an unused floppy disk space of a computer by inserting it into the space, and lifting the front end up to drop an elongated slotway 108 (similar to slotway 97 of receptacle 91 of FIG. 11), formed between stop 104 and an elongated stud 106, onto the front lower edge of the front panel 63 of the associated computer. A drawer 107 having slotways 109 for moving the drawer on the rails 103 of receptacle 101, is slid into the receptacle 101. Inserts and partitions can be provided in drawer 107, as illustrated for other embodiments of the invention.

What I claim is:

1. Apparatus for storing various items in the front panel of a personal computer, for ready access to a user of the computer, comprising:

a box-shaped receptacle having a back wall, opposing side walls, a top, a bottom, and a front opening, configured for sliding through the front panel of a computer into an unused floppy disk space of a computer;

said receptacle including means for securing said receptacle to a computer, wherein items including pencils, erasers, paper clips, floppy disks, and pens can be stored in said receptacle;

a top flange across the top of said receptacle just rearward and parallel to said front opening; and a bottom flange across the bottom of said receptacle just rearward of and parallel to said front opening, said top and bottom flanges serving to limit the extent to which said receptacle can be slid into an unused floppy disk space;

wherein said means for securing includes:

said top and bottom flanges lying in the same vertical plane; and moveable tab means having elastic memory formed in each side wall of said receptacle slightly rearward of the vertical plane common to said top and bottom flanges, whereby as said receptacle is slid into an associated spare floppy disk space, said moveable tab means engages side edges of an opening in a front panel of a computer for snapping into place on the back of said panel, thereby securing said receptacle between said top and bottom flanges, and said moveable tab means to said panel; and wherein said moveable tab means includes a U-shaped cutout in each side of said receptacle, with the bottom of the U-shaped cutout juxtaposed to the vertical plane of said top and bottom flanges, the portions of the material of the sides of said receptacle within the region surrounded by said cutout on three sides forming a tab, said tabs being bent slightly outward and away from their associated sides.

2. The apparatus of claim 1, wherein said top flange is short relative to said bottom flange, said bottom flange further including a pair of relatively small index tabs positioned near the bottom of the face of said bottom flange facing toward the back wall of said receptacle, and spaced apart a distance required for mating with slotted holes in the front panel of a computer, below a spare floppy disk access hole thereof.

3. The apparatus of claim 2, wherein said means for securing includes:

said top and bottom flanges lying in the same vertical plane; and moveable tab means having elastic memory formed in each side of said receptacle slightly rearward of the vertical plane common to said top and bottom flanges, whereby as said receptacle is slid into an associated spare floppy disk space, said moveable tab means engages side edges of an opening in the front panel of a computer for snapping into place on the back of said panel, thereby securing said receptacle between said top and bottom flanges, and said moveable tab means to said panel.

4. The apparatus of claim 1, further including insert means insertable into said receptacle for selectively dividing the interior of said receptacle into a plurality of compartments, thereby permitting a user easy access to both relatively small and short items, and relatively long items, stored in said receptacle.

5. The apparatus of claim 4, wherein said insert means includes:

a base; and a plurality of panel portions secured to the top of said base in a desired configuration for providing said plurality of compartments for said receptacle.

6. The apparatus of claim 1, wherein said means for securing includes:

a top flange across the top front portion of said receptacle slightly rearward of the top edge of said front opening;

a bottom flange across the bottom front portion of said receptacle rearward of the bottom edge of said front opening, and in substantially the same vertical plane as said top flange, said top and bottom flanges limiting the extent to which said receptacle can be slid into a floppy disk space of a computer; and locking tab means located on said receptacle rearward of said top and bottom flanges by slightly more than the thickness of the front panel of a computer, for securing said receptacle to said panel.

7. The apparatus of claim 1, wherein the bottom edge of said front opening of said receptacle is forward of the top edge thereof, thereby slanting the face of said front opening.

8. Apparatus for storing various items in the front panel of a personal computer, for ready access to a user of the computer, comprising:

a box-shaped receptacle having a back wall, opposing side walls, a top, a bottom, and a front opening configured for sliding through the front panel of a computer into an unused floppy disk space of a computer;

said receptacle including means for securing said receptacle to a computer, wherein items including pencils, erasers, paper clips, floppy disks, and pens can be stored in said receptacle;

a top flange across the top of said receptacle just rearward of and parallel to said front opening;

a bottom flange across the bottom of said receptacle just rearward of and parallel to said front opening, said top and bottom flanges serving to limit the extent to which said receptacle can be slid into an unused floppy disk space; and wherein said top flange is relatively short, and said bottom flange is relatively long, said bottom flange further including a pair of relatively small index tabs positioned near the bottom of the inside face of said bottom flange, and spaced apart a distance required for mating with holes in the front panel of a computer, below a spare floppy disk access hole thereof.

9. The apparatus of claim 8, wherein said means for securing includes:

said top and bottom flanges lying in the same vertical plane; and moveable tab means having elastic memory formed in each side wall of said receptacle slightly rearward of the vertical plane common to said top and bottom flanges, whereby as said receptacle is slid into an associated spare floppy disk space, said moveable tab means engages side edges of an opening in a front panel of a computer for snapping into place on the back of said panel, thereby securing said receptacle between said top and bottom flanges, and said moveable tab means to said panel.

10. The apparatus of claim 9, wherein said moveable tab means includes a U-shaped cutout in each side of said receptacle, with the bottom of the U-shaped cutout juxtaposed to the vertical plane of said top and bottom flanges, the portions of the material of the sides of said receptacle within the region surrounded by said cutout on three sides forming a tab, said tabs being bent slightly outward and away from their associated sides.

11. The apparatus of claim 8, wherein said means for securing includes:

said top and bottom flanges lying in the same vertical plane; and moveable tab means having elastic memory formed in each side of said receptacle slightly rearward of the vertical plane common to said top and bottom flanges, whereby as said receptacle is slid into an associated spare floppy disk space, said moveable tab means engages side edges of an opening in said front panel for snapping into place on the back of said panel, thereby securing said receptacle between said top and bottom flanges, and said moveable tab means to said panel.

12. The apparatus of claim 8, further including insert means insertable into said receptacle for selectively dividing the interior of said receptacle into a plurality of compartments, thereby permitting a user easy access to both relatively small and short items, and relatively long items, stored in said receptacle.

13. The apparatus of claim 12, wherein said insert means includes:

a base; and a plurality of panel portions secured to the top of said base in a desired configuration for providing said plurality of compartments for said receptacle.

14. The apparatus of claim 8, wherein said means for securing includes:

a top flange across the top front portion of said receptacle slightly rearward of the top edge of said front opening;

a bottom flange across the bottom front portion of said receptacle rearward of the bottom edge of said front opening, and in substantially the same vertical plane as said top flange, said top and bottom flanges limiting the extent to which said receptacle can be slid into a floppy disk space of a computer; and locking tab means located on said receptacle rearward of said top and bottom flanges by slightly more than the thickness of the front panel of a computer, for securing said receptacle to said panel.

15. The apparatus of claim 8, wherein the bottom edge of said front opening of said receptacle is forward of the top edge thereof, thereby slanting the face of said front opening.

* * * * *